United States Patent [19]

Stallings

[11] 4,315,553

[45] Feb. 16, 1982

[54] CONTINUOUS CIRCULATION APPARATUS FOR AIR DRILLING WELL BORE OPERATIONS

[76] Inventor: Jimmie L. Stallings, 4560 Pinto La., Claremore, Okla. 74017

[21] Appl. No.: 180,655

[22] Filed: Aug. 25, 1980

[51] Int. Cl.[3] ..... E21B 19/00; E21B 21/10; E21B 33/02

[52] U.S. Cl. ..... 175/207; 175/71; 175/212; 175/218

[58] Field of Search ..... 175/207, 209, 210, 212, 175/214, 218, 65, 71; 166/77, 77.5, 84, 95

[56] References Cited

U.S. PATENT DOCUMENTS

| | | | |
|---|---|---|---|
| 2,712,921 | 7/1955 | Redman | 175/212 X |
| 3,788,423 | 1/1974 | Nittinger et al. | 175/209 X |
| 3,800,890 | 4/1974 | Gyongyosi et al. | 175/209 |
| 3,946,818 | 3/1976 | Ek . | |

*Primary Examiner*—Stephen J. Novosad
*Attorney, Agent, or Firm*—Head & Johnson

[57] ABSTRACT

An apparatus for maintaining a continuous supply of air pressure downhole during a well bore drilling operation, even during the addition of a pipe section to the drill string, and comprising a housing installed at the surface of the well at the position of the drilling equipment wherein the upper end of the drill string is separated from the drive mechanism in order that a new piece of drill pipe may be added to the drill string, a flapper or closure member pivotally secured within the housing normally held in an open position by the outer periphery of the drill string and spring urged in a direction toward the open end of the sleeve through which the drive mechanism passes when the drive mechanism has been backed off or removed for the addition of a section of pipe to the drill string, and a by-pass line in communication with the interior of the housing for directing air pressure from the air supply to the housing when the flapper member is in the closed position whereby the air pressure may be circulated downwardly through the drill string for maintaining the air circulation downhole during the entire drilling operation.

6 Claims, 1 Drawing Figure

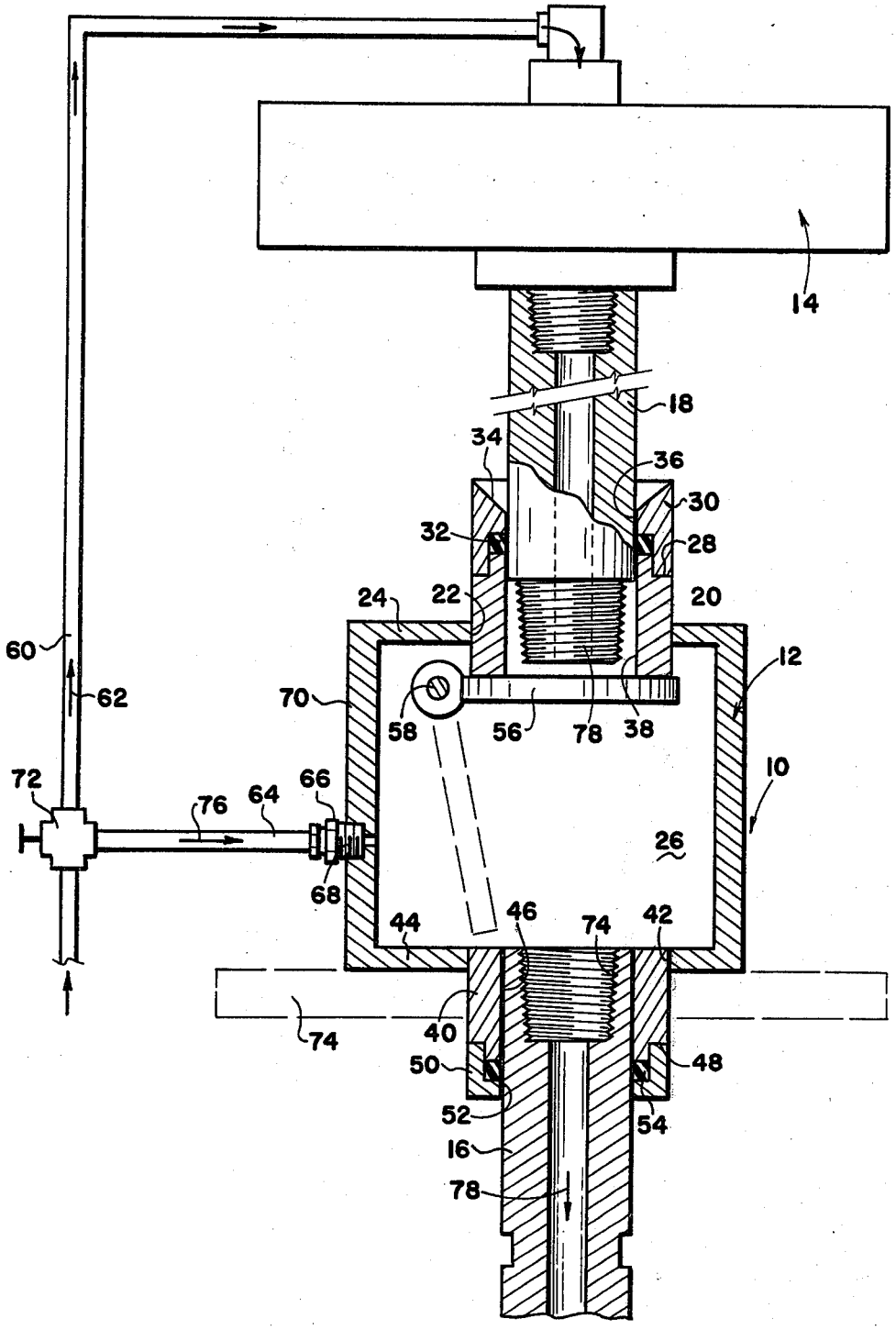
14
18
34
36
30
32
28
24
22
20
12
60
62
70
58
56
78
38
10
72
76
64
66
26
68
44
46
74
42
74
40
50
48
52
54
16
78

CONTINUOUS CIRCULATION APPARATUS FOR AIR DRILLING WELL BORE OPERATIONS

BACKGROUND OF THE INVENTION

1. Field of the Invention

This invention relates to improvements in well bore drilling operations and more particularly, but not by way of limitation, to a means for maintaining continuous air circulation downhole during an air drilling operation.

2. Description of the Prior Art

In some well bore drilling operations, air is utilized as the drilling medium, and the air is circulated downwardly through the drill pipe for excavation of the well bore and to maintain circulation of the down hole water or fluids in order to prevent the water from interfering with the air drilling operation. Each time the drilling operation is interrupted for addition a section of drill pipe to the drill string, the circulation of the air to the bottom of the well bore is interrupted. In instances wherein the well bore drilling operation is being done in an area wherein the water table is encountered in the drilling of the well bore, the interruption of the air pressure is a great disadvantage in that the water quickly fills the hole, and the resumption of the circulation of the air downwardly through the drill stem cannot remove the reservoir of water from the bottom of the well bore, nor can the water be pumped out as fast as it enters the well bore.

SUMMARY OF THE INVENTION

The present invention contemplates a novel apparatus particularly designed and constructed for maintaining a continuous circulation of the drilling air downhole during the well bore drilling operation. The apparatus comprises a housing installed at the surface of the well, preferably at the site wherein the drive mechanism is separated from the upper end of the drill string in order that an additional pipe section may be installed in the drill string. A first sleeve is provided in the housing for receiving the drive mechanism and drill string therethrough, and is open at the inner end thereof to the interior of the housing. A second sleeve is provided in the housing in substantial alignment with the first sleeve for receiving the drill string therethrough, and a chamber is provided within the housing between the two sleeves. A closure means or flapper member is pivotally secured in the chamber and is urged toward a normal position of engagement against the inner end of the first sleeve. Engagement of the flapper member by the drill string or drive mechanism moves the flapper member to an open position for precluding interference with the normal well drilling operation. However, when the drive mechanism has been disengaged from the upper end of the drill string and removed from the housing, the flapper member moves to the normal closed position thereof for closing the housing from the atmosphere. A by-pass conduit or line is in communication with the interior of the housing for directing the air supply into the housing when the drive mechanism has thus been separated from the drill string, and the air pressure is circulated through the housing into the upper end of the drill string for continuous movement downhole while the drive mechanism is disconnected. When the additional pipe section has been secured to the lower end of the drive mechanism and is inserted through the first sleeve member for connection with the upper end of the drill string, the engagement of the drill pipe section with the flapper member will move the flapper member to an open position and communication with the downhole portions of the well bore may be re-established through the drill string in the normal manner. The novel apparatus is simple and efficient in operation and economical and durable in construction.

BRIEF DESCRIPTION OF THE DRAWINGS

The FIGURE is a sectional elevational view of a continuous circulation apparatus embodying the invention as installed for a well bore drilling operation, with portions shown in elevation for purposes of illustration.

DETAILED DESCRIPTION OF THE PREFERRED EMBODIMENT

Referring to the drawings in detail, reference character 10 generally indicates an apparatus for maintaining a continuous supply of air pressure downhole during a well bore drilling operation, and comprising a housing 12 preferably installed at the surface of the well bore (not shown) at the position wherein the usual drive mechanism 14 of the drilling equipment is disconnected or separated from the drill string 16 when it is necessary to add an additional section of drill pipe 18 to the drill string 16, as will be hereinafter set forth in detail. The housing is preferably closed on all sides, and a first sleeve 20 is welded or otherwise secured in a bore 22 provided in the upper wall 24 of the housing. The inner end of the sleeve 22 preferably extends into the interior chamber 26 of the housing 12 and the outer end thereof is provided with an annular shoulder 28 extending around the outer periphery thereof for receiving the end of a cap 30 thereagainst. The cap 30 may be secured to the outer end of the sleeve 20 in any suitable manner (not shown) and it is preferable to provide a suitable sealing means 32 between the cap 30 and the sleeve 20 for precluding leakage of fluid therebetween, as is well known. The outer end 34 of the cap 30 is preferably beveled or tapered inwardly for a purpose as will be hereinafter set forth. The cap 30 is provided with a central bore 36 therein disposed in substantial alignment with a centrally disposed passageway 38 extending through the sleeve 20 for providing communication with the chamber 26.

A second sleeve 40 is welded or otherwise secured in a bore 42 provided in the bottom wall 44 of the housing 12. The sleeves 20 and 40 are preferably of substantially the same diametric size, and the central passageway or bore 46 of the sleeve 40 is in substantial axial alignment with the passageway or bore 38 of the sleeve 20 for a purpose as will be hereinafter set forth. An annular shoulder 48 is provided around the outer periphery of the sleeve 40 for receiving the outer end of a suitable cap member 50 thereagainst, and the cap member 50 is provided with a centrally disposed bore 52 in alignment with the passageway 46 as clearly shown in the drawing. It is preferable to provide a suitable sealing member 54 between the cap member 50 and the sleeve 40 for precluding leakage of fluid therebetween, as is well known.

A closure or flapper member 56 is disposed within the chamber 26 and is pivotally secured therein in any suitable manner, such as by a pivot pin 58 secured between the sidewalls of the housing 12. The flapper member 56 is preferably a substantially flat plate member, and is preferably secured to the pivot pin 58 in such a manner that the flapper is constantly urged in a direction toward the inner end of the sleeve 20 as shown in solid lines in the drawing. It is preferable to provide suitable spring means (not shown) anchored or secured between the pivot pin 58 and the flapper 56 for constantly urging the flapper in the direction of the open inner end of the sleeve 20, as is well known.

The drive mechanism 14 may be of any suitable well known type and is normally provided with suitable gripping or clamping means (not shown) for securing the uppermost drill pipe section 18 and transmitting rotation thereto during a well bore drilling operation. In an air drilling operation, a supply of air at a selected pressure is directed from a suitable source (not shown) through an air line 60 in the direction indicated by the arrows 62, and which is in communication with the interior of the drive mechanism 14 wherein the air pressure is directed downwardly through the drill string 16 during the drilling operation, as will be hereinafter set forth. A by-pass or branch line 64 is connected between the conduit or line 60 and extends into communication with a suitable fitting 66 which is secured in a port 68 provided in a sidewall 70 of the housing 12. A suitable valve 72 is secured at the juncture between the line 60 and the by-pass 64 and is operable for alternately closing the line 60 and establishing communication between the air pressure source and the by-pass 64, and closing the by-pass 64 and establishing communication between the conduit or line 60 and the air pressure source as will be hereinafter set forth in detail.

The housing 12 is preferably installed at the surface of the well bore as hereinbefore set forth, and it may be desirable to provide a suitable leveling device 74 for supporting or securing the housing 12 at the installation site for facilitating the alignment of the sleeves 20 and 40 between the axis of the driving mechanism 14 and drill string 16, as is well known.

During an air drilling operation, the valve 72 is normally in the position whereby the air pressure is communicated from the air supply source (not shown) through the line 60 in the direction indicated by the arrows 62, and into the drive mechanism 14 where the air pressure is directed into the interior of the drill string 16. The air is thus moved downwardly through the drill string 16 to the bottom of the well bore and circulated upwardly through the annulus between the outer periphery of the drill string and the inner periphery of the well bore (not shown) for facilitating the drilling operation, as is well known and in widespread use. The drilling mechanism rotates the drill string and/or moves downwardly therewith as the drill bit (not shown) penetrates the well bore and the drill string 16 moves downwardly therein. When the drill string has moved downwardly a sufficient distance that it becomes necessary to add a section of drill pipe, such as the pipe section 18, to the upper end thereof in order to continue the drilling operation, the drive mechanism 14 is normally disconnected from the normal engagement with the upper end of the drill string and elevated in order to provide a sufficient distance therebetween for the insertion of the pipe section 18 therebetween. When it occurs, the upper end of the drill string 16 will be disposed within the sleeve 40, with the uppermost threaded box 74 thereof being open to the chamber 26, as clearly shown in the drawings. At this time, the valve 72 is activated for closing off the communication between the air supply and the line 60 and establishing communication between the air supply and the by-pass 64 whereby the air pressure is directed through the line 64 in the direction indicated by the arrow 76. Simultaneously with this operation, the drive mechanism 14 will be withdrawn from the sleeve 20, and the flapper 20 will be immediately closed against the open inner end of the sleeve 20 for closing communication between the chamber 26 and the passageway 38. The air in the line 64 will thus move into the chamber 26 and downwardly through the drill string 16, as indicated by the arrow 78, thus maintaining a continuous flow of the air pressure downwardly through the drill string, regardless of whether or not the drive mechanism 14 is connected with the drill string 16.

When the new pipe section 18 has been secured to the drive mechanism 14 in the usual manner, the mechanism and pipe section may be lowered for insertion of the pin end 78 of the pipe 18 through the bore 36 and into the sleeve 20. The beveled end 34 of the cap 30 facilitates the centering of the pipe section 18 with the bore 36 for ease of insertion of the pipe section into the sleeve 20, as is well known. As the pin member 78 engages the flapper 56 during lowering of the pipe section 18 through the sleeve 20, the flapper will be opened, and continued downward movement of the pipe section 18 will bring the pin member 78 into engagement with the box portion 74 for the usual threaded connection therebetween. The flapper member 56 will ride along the outer periphery of the pipe section 18 and will thus be retained in an open position until such time as it is necessary to again separate the drive mechanism 14 from the drill string 16.

At the same time the pipe section 18 is moved into the sleeve 20, the valve 72 may be actuated to a position for establishing communication between the air supply and the line 60 and clocking the communication with the by-pass 64. This directs the air pressure through the pipe 60 in the direction indicated by the arrows 62 for discharging into the drive mechanism 14 for movement downwardly through the drill string 16 in the usual manner during the continuing of the well bore drilling operation.

From the foregoing it will be apparent that the present invention provides a novel apparatus for maintaining a continuous flow of air or continuous circulation of the air stream downwardly through the drill string and upwardly in the annulus between the drill string and well bore during a well bore drilling operation. The apparatus comprises a housing having a pivotal flapper member for automatically sealing the open upper end of the drill string from the atmosphere during the addition of a pipe section at the upper end of the drill string, and the air stream is diverted into the housing when the flapper member is in the sealing position. In this manner the air stream is continually directed into the drill string for movement longitudinally downwardly therethrough. When the new pipe section is lowered for connection with the upper end of the drill string, the flapper member is opened and the air stream is redirected into the upper end of the new pipe section, which has become a part of the drill string, and the drilling operation may be continued in the usual manner without loss of air pressure at the bottom of the well bore.

Whereas the present invention has been described in particular relation to the drawings attached hereto, it should be understood that other and further modifications, apart from those shown or suggested herein may be made within the spirit and scope of this invention.

What is claimed is:

1. Apparatus for maintaining a continuous circulation of an air stream through a drill string during the drilling of a well bore and comprising housing means secured in the proximity of the surface of the well bore for receiving the drill string therethrough, first and second port means provided in the housing in communication with an internal chamber and for receiving the drill string therethrough, said chamber being disposed around the outer periphery of a portion of the drill string during the well drilling operation and isolating the upper end of the drill string from the atmosphere during separation of the drill string upon an interruption of the drilling operation, flapper means pivotally secured in the housing and disposed within the chamber for engagement with one of said port means in the separated position of the drill string to provide said isolation therefor, by-pass means having one end in communication with the air stream and the opposite end in communication with the chamber for directing the air stream into the chamber during said separation of the drill string for direction of the air stream through the drill string during the interruption of the drilling operation, means connected with said by-pass means for selective closing thereof from said air stream whereby the air stream is directed into the drill string remotely from the housing during a continuation of the drilling operation thus providing a continuous circulation of the air stream through the drill string both during the drilling operation and during an interruption of the drilling operation.

2. Apparatus for maintaining a continuous circulation of an air stream through a drill string as set forth in claim 1 wherein said flapper means is constantly urged toward engagement with said one port means, and is moved away from said port means by the drill string during continuation of the drilling operation.

3. Apparatus for maintaining a continuous circulation of an air stream through a drill string as set forth in claim 1 wherein the port means comprises first sleeve means secured to the housing and having one end thereof extending into the chamber for engagement by said flapper means, and second sleeve means secured to the housing in substantial axial alignment with the first sleeve means for receiving the separated portion of the drill string therein during the interruption of the drilling operation.

4. Apparatus for maintaining a continuous circulation of an air stream through a drill string as set forth in claim 3 and including cap means secured to the opposite end of said first sleeve means, sealing means interposed between said cap means and said first sleeve means for precluding leakage of fluid therebetween, second cap means secured to the outer end of said second sleeve means, and sealing means interposed between the second cap means and second sleeve means for precluding leakage of fluid therebetween.

5. Apparatus for maintaining a continuous circulation of an air stream through a drill string as set forth in claim 4 wherein the outer end of the first mentioned cap means is beveled radially inwardly for facilitating insertion of the drill string into said first sleeve means.

6. Apparatus for maintaining a continuous circulation of an air stream through a drill string as set forth in claim 1 wherein the means connected with the by-pass means is a valve operable for selectively diverting the flow of the air stream to the by-pass means.

* * * * *